US007441671B2

(12) United States Patent
McPhee

(10) Patent No.: US 7,441,671 B2
(45) Date of Patent: Oct. 28, 2008

(54) SHIPPING CONTAINER WITH AUXILIARY DOOR FOR BULK CARGO

(75) Inventor: Doug McPhee, Duncan (CA)

(73) Assignee: Superior Bulk Containers Ltd., Duncan (CA)

( * ) Notice: Subject to any disclaimer, the term of this patent is extended or adjusted under 35 U.S.C. 154(b) by 124 days.

(21) Appl. No.: 11/370,935

(22) Filed: Mar. 9, 2006

(65) Prior Publication Data

US 2006/0201939 A1 Sep. 14, 2006

Related U.S. Application Data

(60) Provisional application No. 60/659,894, filed on Mar. 10, 2005.

(51) Int. Cl.
*B65D 88/00* (2006.01)
*B65D 51/18* (2006.01)

(52) U.S. Cl. ..... 220/1.5; 220/254.6

(58) Field of Classification Search ..... 220/1.5, 220/4.29, 4.28, 254.6, 254.3, 254.2, 254.1, 220/252, 255, 826, 822, 821, 820; 217/57, 217/56, 48, 16, 62, 59; 105/404, 355, 282.1, 105/281, 280, 249, 248, 247; 49/67, 65, 49/63, 62, 61, 398, 397, 395, 394
See application file for complete search history.

(56) References Cited

U.S. PATENT DOCUMENTS

| | | | | | |
|---|---|---|---|---|---|
| 155,911 | A | * | 10/1874 | Wissler | 49/56 |
| 284,117 | A | * | 8/1883 | Byar | 160/91 |
| 291,699 | A | * | 1/1884 | De Berry | 217/16 |
| 818,257 | A | | 4/1906 | Kennedy | |
| 1,086,603 | A | * | 2/1914 | Merker | 160/91 |
| 1,259,320 | A | | 3/1918 | Tyler | |
| 1,336,896 | A | * | 4/1920 | Driver et al. | 220/1.5 |
| 1,765,591 | A | * | 6/1930 | Kellett | 220/1.5 |
| 2,172,649 | A | * | 9/1939 | Claus | 49/62 |
| 2,315,365 | A | * | 3/1943 | Christy | 49/169 |
| 2,553,471 | A | * | 5/1951 | Protzeller | 62/405 |
| 2,584,059 | A | * | 1/1952 | Stackhouse, Jr. | 52/784.13 |
| 2,654,498 | A | * | 10/1953 | Jennison | 217/14 |
| 3,398,850 | A | * | 8/1968 | Kennard | 220/6 |
| 3,799,384 | A | | 3/1974 | Hurkamp | |
| 3,812,772 | A | * | 5/1974 | Kaiser | 454/319 |
| 3,832,605 | A | * | 8/1974 | Clark, Jr. | 174/481 |
| 3,852,915 | A | * | 12/1974 | Schacht | 49/143 |
| 3,907,147 | A | | 9/1975 | Goobeck | |
| 3,915,327 | A | * | 10/1975 | Lovich et al. | 220/1.5 |
| 4,231,481 | A | | 11/1980 | Nash et al. | |
| 4,357,736 | A | * | 11/1982 | Karpisek | 16/263 |
| 4,420,183 | A | | 12/1983 | Sherman | |
| 4,684,034 | A | | 8/1987 | Ono et al. | |

(Continued)

FOREIGN PATENT DOCUMENTS

WO WO 9106735 A1 * 5/1991

*Primary Examiner*—Anthony D Stashick
*Assistant Examiner*—Robert J. Hicks

(57) ABSTRACT

A shipping container has an interior, a first main door, a second main door and an auxiliary door. In a closed position, the auxiliary door cooperates with one of the main doors to form a bulkhead which blocks access to the interior. The auxiliary door comprises a plurality of separately moveable portions moveable between open and closed positions. At least one of the portions is moveable to an open position which permits access to the interior of the shipping container.

12 Claims, 6 Drawing Sheets

U.S. PATENT DOCUMENTS

| | | | | | |
|---|---|---|---|---|---|
| 4,799,607 | A | | 1/1989 | Podd | |
| 4,884,722 | A | | 12/1989 | Podd | |
| 5,160,357 | A | * | 11/1992 | Faber | 55/385.2 |
| 5,190,179 | A | | 3/1993 | Richter et al. | |
| 5,269,414 | A | | 12/1993 | D'Hollander | |
| 5,415,311 | A | | 5/1995 | Coogan | |
| 5,501,333 | A | | 3/1996 | Swan | |
| 5,667,090 | A | * | 9/1997 | Langham et al. | 220/6 |
| 5,706,964 | A | | 1/1998 | Podd et al. | |
| 5,735,639 | A | * | 4/1998 | Payne et al. | 405/129.57 |
| 5,824,995 | A | | 10/1998 | Wise | |
| RE36,214 | E | | 6/1999 | Podd, Sr. et al. | |
| 6,006,918 | A | | 12/1999 | Hart | |
| 6,138,580 | A | * | 10/2000 | Thoman | 105/396 |
| 6,206,623 | B1 | * | 3/2001 | Podd | 410/130 |
| 6,401,953 | B2 | | 6/2002 | Kofod | |
| 6,415,938 | B1 | | 7/2002 | Karpisek | |
| 6,533,122 | B1 | | 3/2003 | Plunkett | |
| 6,615,741 | B2 | | 9/2003 | Fecko et al. | |
| 6,726,046 | B2 | | 4/2004 | Orset | |
| 7,032,771 | B2 | * | 4/2006 | Pfau et al. | 220/685 |
| 2004/0094545 | A1 | | 5/2004 | Carter et al. | |
| 2004/0188433 | A1 | * | 9/2004 | Morales et al. | 220/1.5 |

* cited by examiner

SHIPPING CONTAINER WITH AUXILIARY DOOR FOR BULK CARGO

REFERENCE TO RELATED APPLICATION

This application claims the benefit under 35 U.S.C. §119 of U.S. patent application Ser. No. 60/659,894 filed on 10 Mar. 2005 and entitled SHIPPING CONTAINER WITH AUXILIARY DOOR FOR BULK CARGO.

TECHNICAL FIELD

The invention relates to shipping containers, and in particular to shipping containers useful for carrying both bulk and packaged cargo.

BACKGROUND

A conventional shipping container is typically used to transport packaged goods, but is not suitable for transportation of bulk goods. Such shipping containers have paired vertical doors that swing outward to open one end of the container. The doors permit access to the interior of the container but they are not adapted to loading and unloading of bulk goods. Accordingly, when conventional shipping containers are used, for example, to transport packaged goods from Asia to North America, the containers are often returned to Asia empty because of the trade imbalance in packaged goods, even though there may be bulk goods awaiting shipping from North America to Asia.

Despite the various structures that have been proposed for shipping bulk goods in standard shipping containers there remains a need for shipping containers which may be used in a practical and cost-effective manner to transport both packaged goods and bulk goods.

SUMMARY OF INVENTION

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

One aspect of the invention provides a shipping container with an interior, a first main door, a second main door, and an auxiliary door. The auxiliary door is moveable between an open position and a closed position. In the closed position, the auxiliary door cooperates with one of the main doors to form a bulkhead which blocks access to the interior.

The auxiliary door may have a plurality of separately moveable portions moveable between open position and closed positions. At least one of the portions is moveable to an open position which permits access to the interior of the shipping container.

Another aspect of the invention provides a shipping container with an interior, at least one main door, a first auxiliary door and a second auxiliary door. The auxiliary doors are moveable between an open position and a closed position. In the closed position, the auxiliary doors cooperate to form a bulkhead which blocks access to the interior.

A further aspect of the invention provides a shipping container with an interior, at least one main door and an auxiliary door. The auxiliary door is moveable between an open position and a closed position, wherein the closed position the auxiliary door forms a bulkhead which blocks access to the interior.

In addition to the exemplary aspects and embodiments described above, further aspects and embodiments will become apparent by reference to the drawings and by study of the following detailed descriptions.

BRIEF DESCRIPTION OF DRAWINGS

Exemplary embodiments are illustrated in referenced figures of the drawings. It is intended that the embodiments and figures disclosed herein are to be considered illustrative rather than restrictive. In the drawings which illustrate non-limiting embodiments of the invention.

DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

Figure 1:
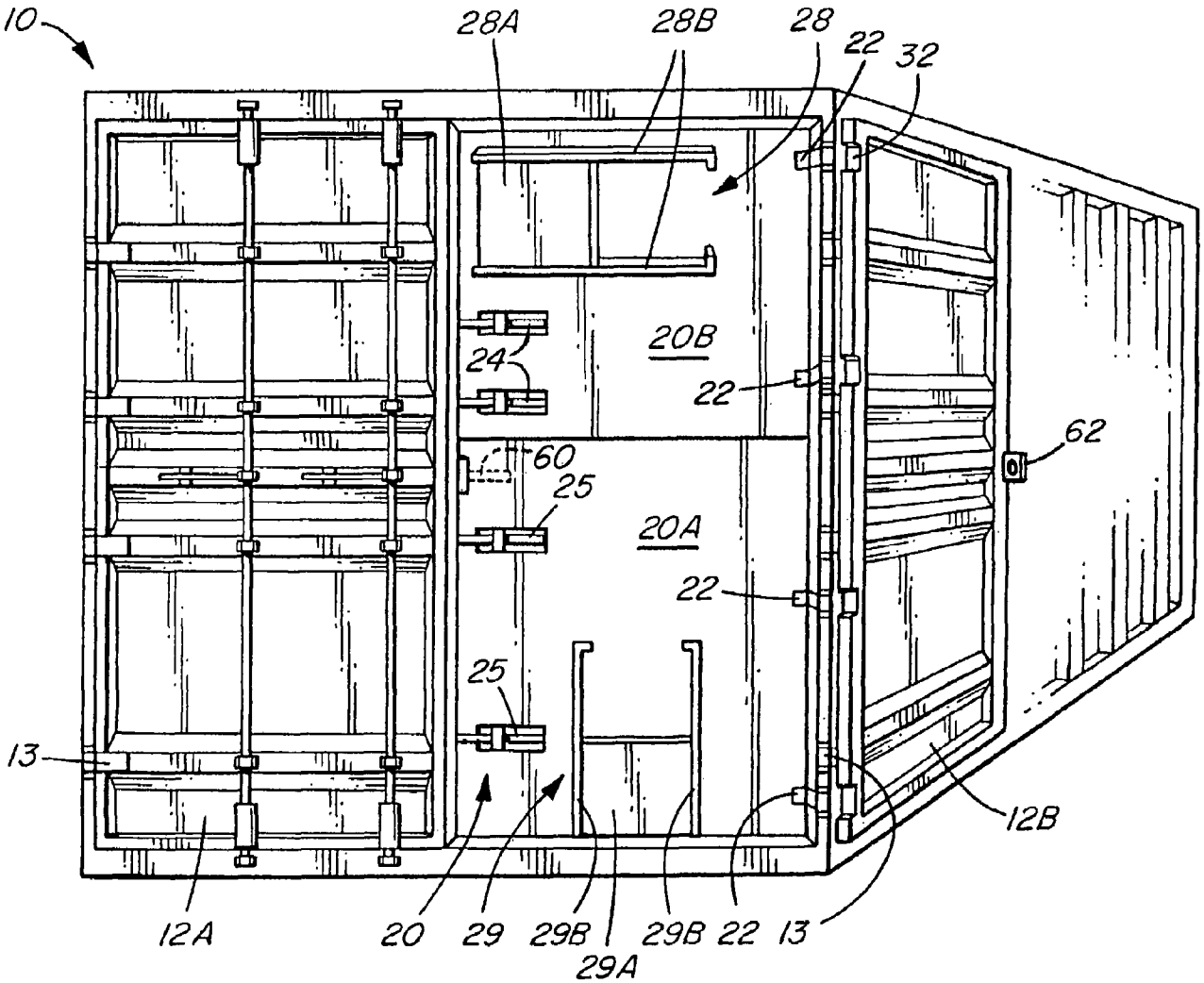
FIG. 1 is a perspective view of a shipping container, including an auxiliary door according to the invention, with a main door open.

FIG. 1 shows a shipping container 10 according to one embodiment of the invention. Shipping container 10 may be an ISO standard shipping container. In FIG. 1, main door 12A is shown latched in a closed position while main door 12B is open. Shipping container 10 includes an auxiliary door 20 which is mounted just to the rear of main door 12B. Auxiliary door 20 can be used while loading bulk cargo 63 into interior 40 (FIG. 2) of shipping container 10 or unloading bulk cargo 63 from interior 40. Auxiliary door 20, when closed and latched (as shown in FIG. 1), cooperates with main door 12A to block the open end of shipping container 10.

Figure 6:
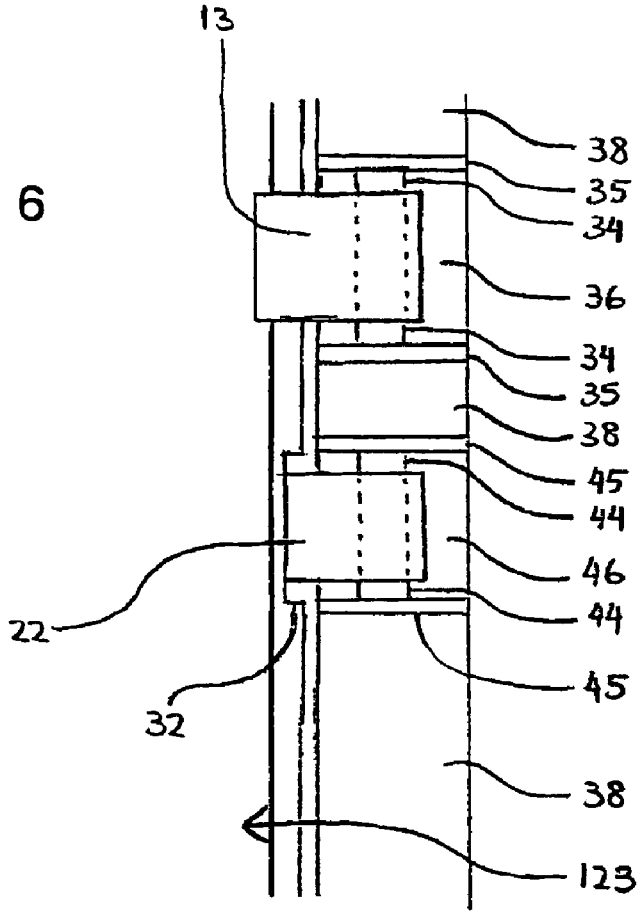
FIG. 6 is a partial front view illustrating the arrangement of hinges according to one specific embodiment of the invention.
Figure 7:
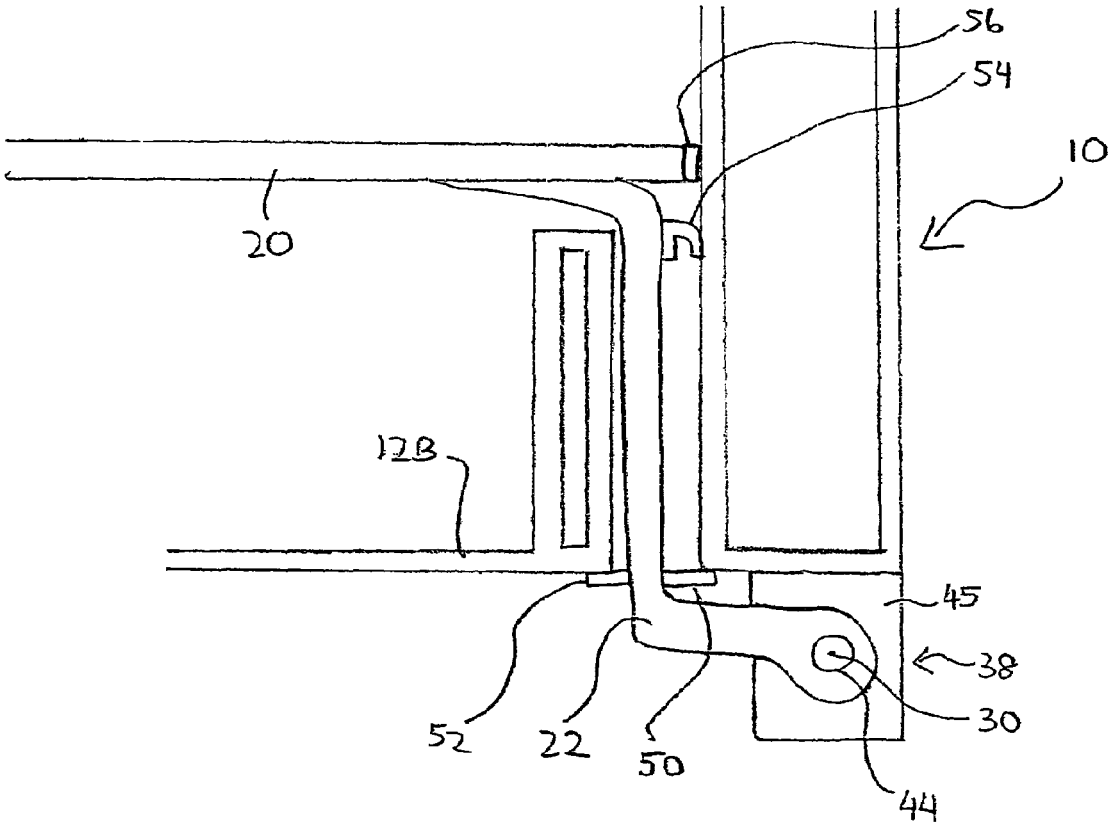
FIG. 7 is an enlarged sectional top view illustrating the arrangement of the hinge of the auxiliary door in the embodiment shown in FIG. 6.
Figure 8:
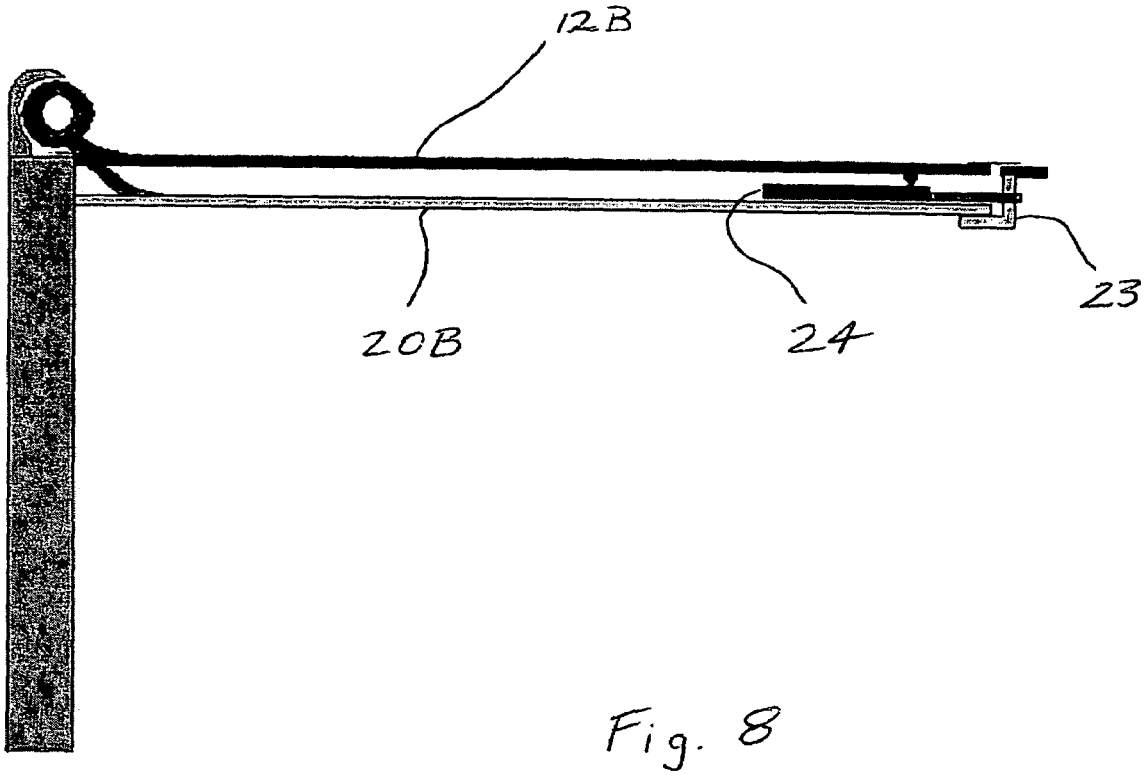
FIG. 8 is a top view sectional view of the main and auxiliary doors in a closed position.

Auxiliary door 20 pivots on four hinges 22 that have a common axis of rotation 30 (FIG. 7) with four hinges 13 of main door 12B. As shown in FIG. 6, hinge 13 of main door 12B couples to hinge pin 34. The top and bottom ends of hinge pin 34 are fixed to paired plates 35. Plates 35 are fixed in cutout 36 of vertical member 38. Hinge 22 of auxiliary door 20 extends forwardly and outwardly through notch 32 at the outer edge of main door 12B and couples to hinge pin 44 (FIGS. 6 and 7). As shown in FIG. 6, the top and bottom ends of hinge pin 44 are fixed to plates 45 which, in turn, are fixed in cutout 46 of vertical member 38.

As illustrated in FIG. 7, the opening created by notch 32 may be sealed by seal 50 attached to a forward and outward portion of hinge 22 and seal 52 attached to the outer edge of the front face of main door 12B. Seal 54 attached to a rearward and outward portion of hinge 22 and seal 56 attached along the outer edge of auxiliary door 20 may provide further sealing. Seals 50, 52, 54 and 56 protect bulk cargo 63 in interior 40 from exposure to the environment outside of container 10. Seal 56 also prevents bulk cargo 63 from leaking around the edges of auxiliary door 20.

As shown in FIG. 1, auxiliary door 20 has one or more (and preferably four) latches 24, 25 that engage with main door 12A. Auxiliary door 20 and main door 12A can thereby be configured to form a bulkhead which closes the open end of container 10 to confine bulk cargo 63 to interior 40.

Auxiliary door 20 has hatches 28, 29 which may be slid open to introduce bulk cargo 63, such as grain or the like, into interior 40 or to remove bulk cargo 63 from interior 40 of container 10. Hatch 28 is preferably located near the top inner corner of auxiliary door 20. Hatches 28, 29 may be of any suitable construction. In the illustrated embodiment hatches 28, 29 comprise doors, 28A, 29A that slide on tracks, 28B, 29B respectively. Doors 28A, 29A may be slid along the tracks to reveal corresponding openings which extend through auxiliary door 20. Hatches 28, 29 may be provided with a suitable locking mechanism (not shown) to keep the hatches in an open or a closed position.

Figure 5:
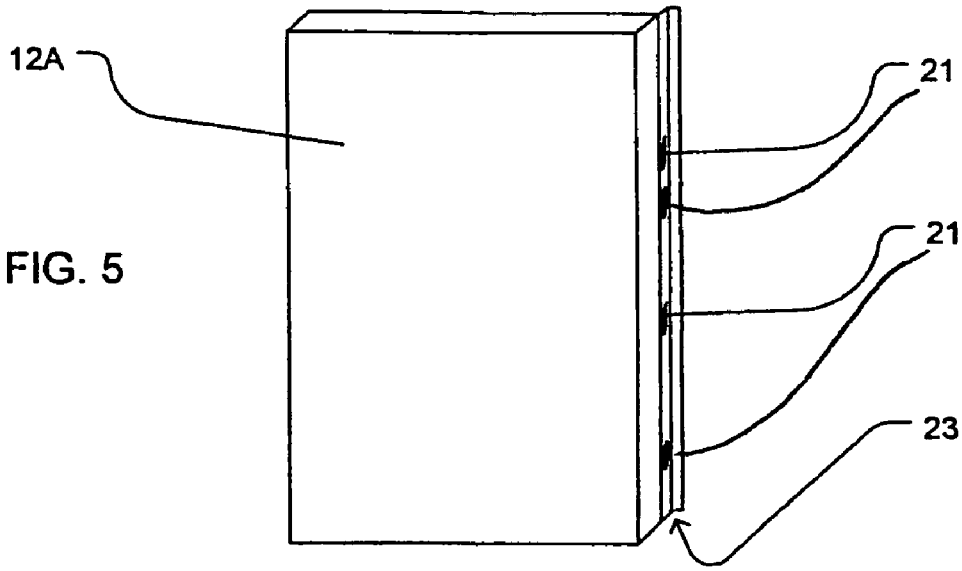
FIG. 5 shows a main door of the shipping container of FIG. 1.

In the illustrated embodiment, latches 24, 25 are disposed along the inner edge of the front face of auxiliary door 20. Latches 24, 25 can retract from the inner edge of auxiliary door 20 to allow auxiliary door 20 to close against main door 12A. When auxiliary door 20 is closed, the plane of auxiliary door 20 is just rearward of the plane of main door 12A. To lock auxiliary door 20, latches 24, 25 can be extended to engage holes 21 in a member 23 affixed to the rear of main door 12A when main door 12A is closed (shown in FIG. 5). Latches 24 and 25 may comprise dead bolts or the like. Latches 24 and 25 only project forward from the outer face of auxiliary door 20 for a small enough distance that they do not interfere with closing main door 12B. Preferably, there are two latches provided on each of upper portion 20A and lower portion 20B of door 20.

Figure 2:
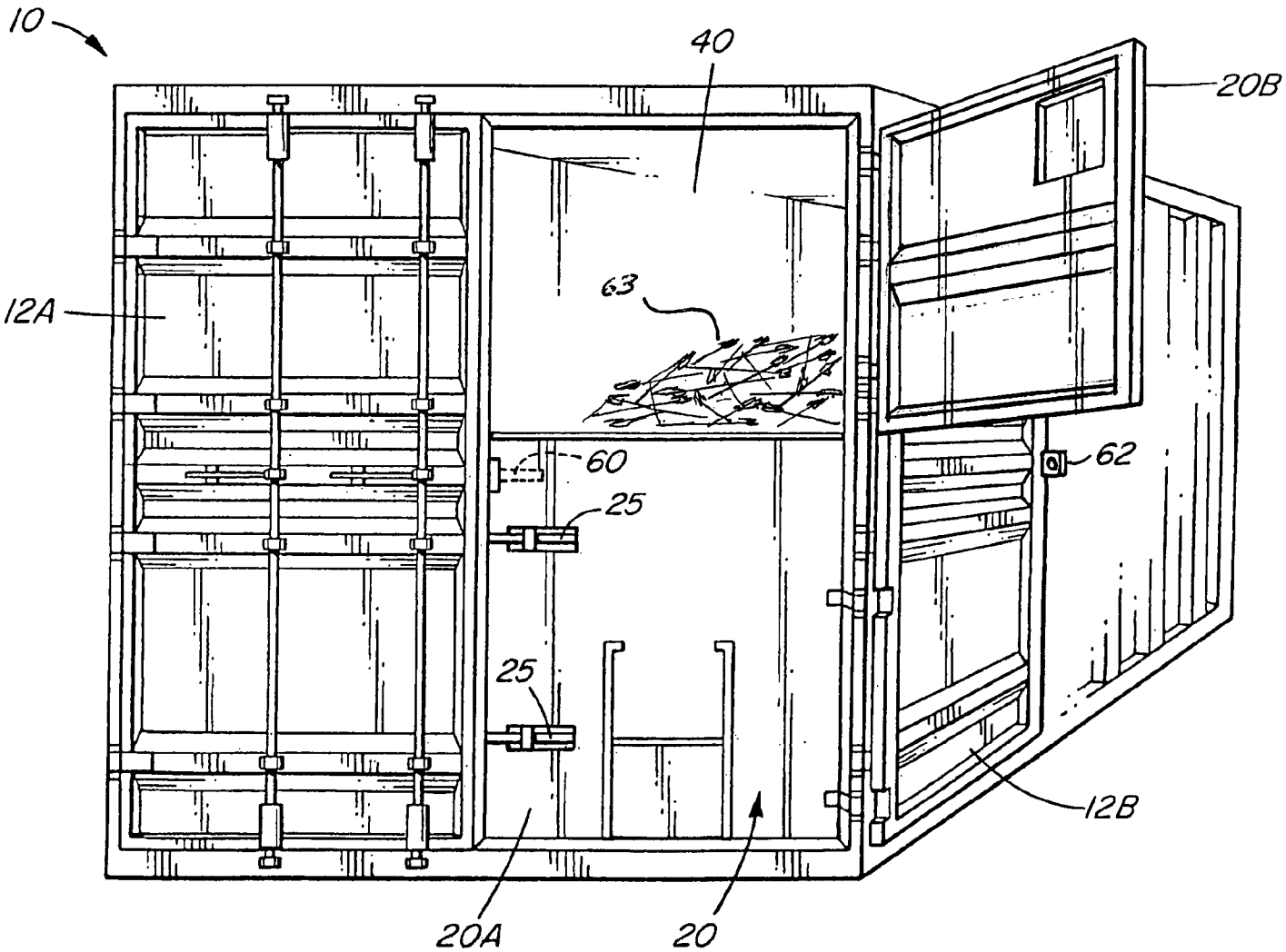
FIG. 2 shows the shipping container of FIG. 1 with a top portion of the auxiliary door open.
Figure 3:
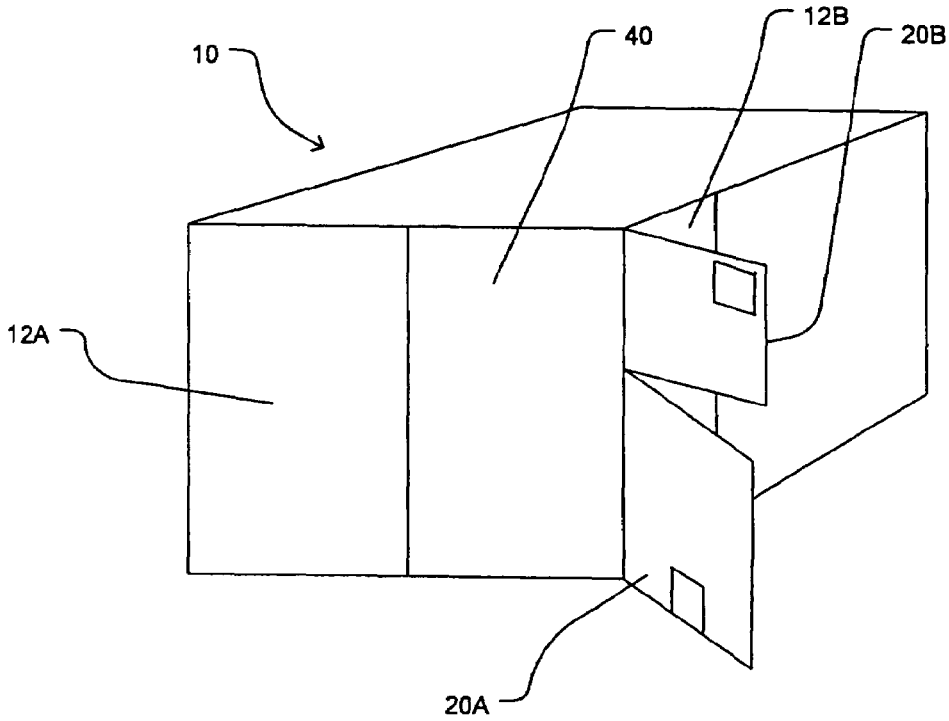
FIG. 3 shows, schematically, the shipping container of FIG. 1 with both portions of the auxiliary door open.

In the illustrated embodiment, auxiliary door 20 has two separately hinged portions, a lower portion 20A and an upper portion 20B. Auxiliary door 20 is designed to permit upper portion 20B to be opened while lower portion 20A remains closed and latched as shown in FIG. 2. In the alternative, both upper and lower portions 20A and 20B may be opened at the same time to provide access to interior 40 as shown in FIG. 3. A lip (not shown) of suitable material may be attached to or extend from an upper part of the back of lower portion 20A to provide a seal between the lower portion 20A and upper portion 20B when auxiliary door 20 is closed.

Figure 4:
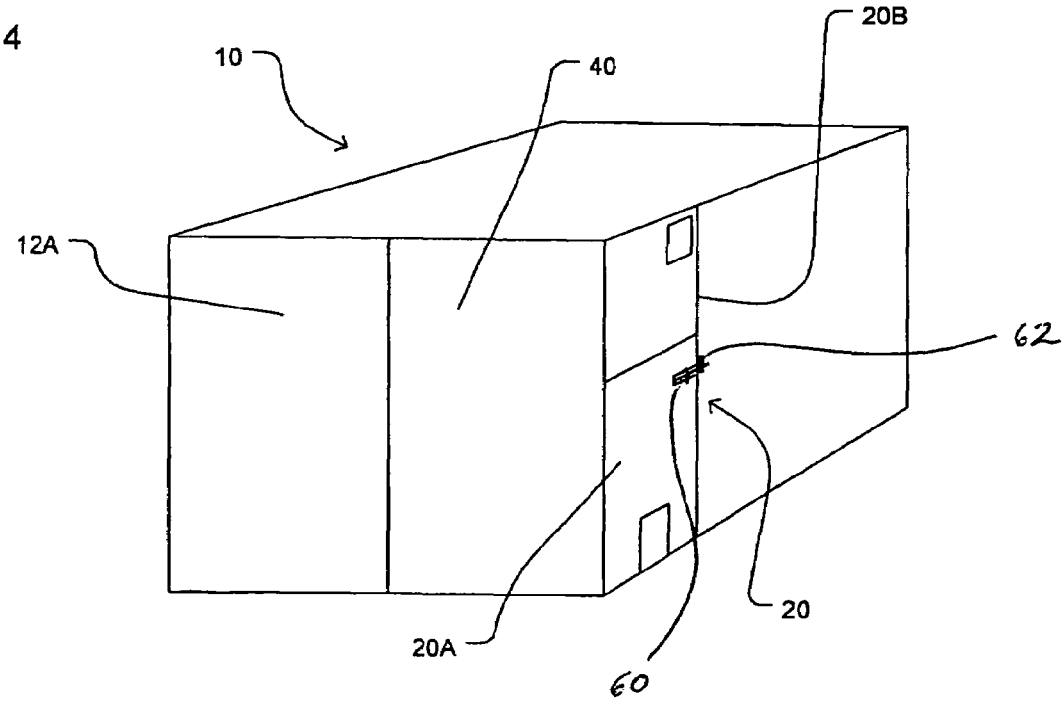
FIG. 4 shows the shipping container of FIG. 1 having the auxiliary door latched to the rear face of the main door.

Preferably, auxiliary door 20 can be latched to the inner face of main door 12B, preferably by means of inner latch 60. Latch 60 may be fashioned as a deadbolt engageable with a tab 62 on the edge of door 12B. When auxiliary door 20 is latched to the inner face of main door 12B, as shown in FIG. 4, main door 12B and auxiliary door 20 can be opened and closed together, as though auxiliary door 20 was not present and container 10 can be used as a general purpose container, for example for shipping packaged goods.

Container 10 may be used to ship bulk goods by opening main doors 12A and 12B and auxiliary door 20 and removing any debris etc. from interior 40 of container 10. Then bulk cargo 63 may be introduced into interior 40 through the open end of container 10. It would be possible to fill much of interior 40 while leaving main doors 12A and 12B and auxiliary door 20 open. When the bulk cargo 63 approaches the open end of the container then main door 12A can be closed and latched and the lower portion 20A of auxiliary door 20 can be closed and latched to main door 12A. This leaves the entire area of the upper portion of auxiliary door 20 open. Bulk cargo 63 can continue to be introduced through the upper portion of auxiliary door 20 by way of a conveyor, blower or the like.

For twenty-foot equivalent unit (TEU) containers, most bulk cargo can be filled to the top of interior 40. During the final stages of loading, upper portion 20B can be closed and latched, and more bulk cargo can be loaded into interior 40 through opened hatch 28. Once container 10 is sufficiently filled, hatch 28 can be closed and then main door 12B can be closed and latched.

For forty-foot equivalent unit (FEU) containers, the density of most bulk cargo limits filling of interior 40 to approximately the halfway point. Accordingly, the lower portion of 20A auxiliary door 20 may be high enough to contain all the bulk cargo that can be safely placed within container 10. In such cases all that is needed is to fill interior 40 with bulk cargo to the desired level and then close and latch the upper portion 20B of auxiliary door 20 and then close and latch main door 12B. With less dense bulk cargo, FEU containers may be filled to the top.

When container 10 reaches its destination the bulk cargo can be unloaded by opening hatch 29 to release the pressure of the bulk cargo in interior 40 against the inner face of auxiliary door 20. Auxiliary door 20 can then be opened and the remaining cargo in interior 40 unloaded by tilting, vacuuming or other suitable means. In the alternative, unloading may comprise opening upper portion 20A of auxiliary door 20 or hatch 28 to receive a vacuum hose or other unloading mechanism.

As will be apparent to those skilled in the art in the light of the foregoing disclosure, many alterations and modifications are possible in the practice of this invention without departing from the spirit or scope thereof. For example:

- The number, type and arrangement of hatches on auxiliary door 20 may be varied. In other embodiments, auxiliary door 20 may not have hatches;
- The number and arrangement of separately moveable portions comprising auxiliary door 20 may be varied;
- Latches 24 and 25 may be substituted with any suitable locking mechanism. Magnetic locks may be used, for example;
- Container 10 could be a truck trailer, an enclosed compartment of a truck, a train car, or other shipping container suitable for carrying both bulk goods and packaged goods;
- Auxiliary door 20 may be stowed against the rear face of main door 12A. For example, auxiliary door 20 may be pivotally coupled along the inside edge of main door 12A and deployed by swinging outward to close off access to interior 40. In a further example, auxiliary door 20 may be disposed on tracks on the rear face of main door 12A, and deployed by sliding out to close off the access to interior 40;
- Auxiliary door 20 may be paired with a similarly featured auxiliary door 20' (not shown) having hinges sharing a common axis of rotation as the hinges of main door 12A. When main doors 12A, 12B are opened, auxiliary doors 20, 20' may be latched to each other to form a bulkhead closing off the open end of container 10;

In shipping containers having only one main door, for example, auxiliary door 20 may, by itself, be sufficient to close off access to interior 40.

The invention may be embodied in the form of a kit comprising an auxiliary door and hardware for attaching the door to a shipping container to provide a shipping container according to the invention.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

What is claimed is:

1. A shipping container suitable for shipping both packaged goods and bulk goods, the container comprising:

a roof, a floor and walls enclosing an interior compartment;

first and second main doors respectively pivotally mounted on first and second sides of an opening in the walls, the first and second main doors each pivotally moveable between a closed configuration and an open configuration, wherein the opening is blocked by the first and second main doors when the first and second main doors are in their closed positions;

an auxiliary door deployable in a storage configuration and, when the first main door is in its closed position, in a bulkhead configuration wherein, when the auxiliary door is in the bulkhead configuration, the auxiliary door extends from the second side of the opening to meet the closed first main door thereby providing a bulkhead spanning the opening and the second main door can be opened to expose the auxiliary door and, when the auxiliary door is in its storage configuration the auxiliary door is detachably supported on a rear face of one of the first and second main doors and the one of the first and second main doors supporting the auxiliary door can be opened and closed while carrying the auxiliary door.

2. A shipping container according to claim 1 wherein the auxiliary door is pivotally mounted on a common pivot axis with the second main door inside the second main door.

3. A shipping container according to claim 2 wherein the auxiliary door is detachably engageable to the second main door.

4. A shipping container according to claim 2 wherein the auxiliary door is supported by members that extend through notches in an edge of the second main door to engage hinge pins.

5. A shipping container according to claim 2 wherein the auxiliary door comprises an upper part and a lower part, the upper and lower parts separately hinged to the container on the second side of the opening.

6. A shipping container according to claim 5 comprising a first hatch in the lower part and a second hatch in the upper part.

7. A shipping container according to claim 5 comprising a first latch detachably engaging the upper part of the auxiliary door to the first main door and a second latch detachably engaging the lower part of the auxiliary door to the first main door wherein the upper part of the auxiliary door can be opened while the lower part of the auxiliary door is closed and latched to the first main door.

8. A shipping container according to claim 1 wherein the first and second main doors are flat against an outside of the container when in their open configurations.

9. A shipping container suitable for shipping both packaged goods and bulk goods, the container comprising:

a roof, a floor and walls enclosing an interior compartment;

first and second main doors respectively pivotally mounted on first and second sides of an opening in the walls, the first and second main doors each pivotally moveable between a closed configuration and an open configuration, wherein the opening is blocked by the first and second main doors wherein the first and second main doors are in their closed positions;

an auxiliary door pivotally mounted on a common pivot axis with the second main door inside the second main door, the auxiliary door having a closed position wherein, when the first main door is in its closed position, the auxiliary door meets the first main door to provide a bulkhead across the opening and the second main door can be opened to expose the closed auxiliary door;

a latch detachably engageable to retain the auxiliary door in its closed position;

wherein the auxiliary door is detachably engageable to the second main door and, when so engaged, opens and closes with the second main door.

10. A shipping container according to claim 9 wherein the auxiliary door comprises an upper part and a lower part, the upper and lower parts separately hinged to the container on the second side of the opening.

11. A shipping container according to claim 10 comprising a first hatch in the lower part and a second hatch in the upper part.

12. A shipping container according to claim 10 wherein the latch comprises at least a first latch detachably engaging the upper part of the auxiliary door to the first main door and a second latch detachably engaging the lower part of the auxiliary door to the first main door wherein the upper part of the auxiliary door can be opened while the lower part of the auxiliary door is closed and latched to the first main door.

* * * * *